US006647564B1

(12) United States Patent
Smith

(10) Patent No.: US 6,647,564 B1
(45) Date of Patent: Nov. 18, 2003

(54) BACK SCRUBBER

(76) Inventor: Gary Smith, 1565-1 Foxbridge Rd., Dalton, GA (US) 30721

( * ) Notice: Subject to any disclaimer, the term of this patent is extended or adjusted under 35 U.S.C. 154(b) by 0 days.

(21) Appl. No.: 10/273,671

(22) Filed: Oct. 18, 2002

(51) Int. Cl.[7] ..... A47K 7/02
(52) U.S. Cl. ..... 4/606; 15/176.5
(58) Field of Search ..... 4/606; 15/104.92, 15/176.4, 176.5

(56) References Cited

U.S. PATENT DOCUMENTS 3,087,183 A * 4/1963 Semon ..... 15/244.1
3,167,799 A * 2/1965 McKinley ..... 15/176.4
4,020,519 A * 5/1977 Robison ..... 15/104.92
5,277,389 A * 1/1994 Ballares et al. ..... 248/206.3
5,311,635 A * 5/1994 Moore ..... 15/244.3
5,600,864 A * 2/1997 Huber ..... 15/118
5,784,722 A * 7/1998 Ureta et al. ..... 4/606
5,822,824 A * 10/1998 Dion ..... 15/210.1
D400,658 S * 11/1998 Mejia, Sr. ..... D23/304
6,370,722 B1 * 4/2002 Duckworth ..... 15/104.92

* cited by examiner

*Primary Examiner*—Charles E. Phillips

(57) ABSTRACT

A wall-mountable back scrubber is provided, comprising a rectangular base unit with adapter mounts and suction cups attached to the rear surface, slots with adjacent tabs in the front surface, and a compartment and soap dish in the top, along with a brush unit with adapter mounts attached to the rear surface, wherein the adapter mounts attached to the brush unit are configured to fit within the slots in the rectangular base unit and be held in place by the tabs. The back scrubber has particular utility in connection with scrubbing with a soothing and massaging effect.

20 Claims, 2 Drawing Sheets

BACK SCRUBBER

BACKGROUND OF THE INVENTION

1. Field of the Invention

The present invention relates to a back scrubber for use in connection with showering. The back scrubber has particular utility in connection with scrubbing with a soothing and massaging effect.

2. Description of the Prior Art

Back scrubbers are desirable for cleaning with ease and with minimal movement.

The use of back scrubbers is known in the prior art. For example, U.S. Pat. No. 5,784,722 to Ureta et al. discloses a shower back scrubber. However, the shower back scrubber of the Ureta '722 patent does not provide a removeable brush, and additionally does not provide compartments for the storage of shower articles such as soap and shampoo.

U.S. Pat. No. 5,600,864 to Huber discloses a reversible back scrubber. However, the back scrubber of the Huber '864 patent does not provide a removeable brush, and additionally does not provide compartments for the storage of shower articles such as soap and shampoo.

Similarly, U.S. Pat. No. 5,277,389 to Ballares et al. discloses a no hands shower back scrubber. However, the shower back scrubber of the Ballares '389 patent does not provide a removeable brush, and cannot provide compartments for the storage of shower articles such as soap and shampoo.

U.S. Pat. No. 5,822,824 to Dion discloses a mountable washing device. However, the mountable washing device of the Dion '824 patent does not provide a removeable brush, and additionally does not provide compartments for the storage of shower articles such as soap and shampoo.

U.S. Pat. No. 5,311,635 to Moore discloses a shower bath aid. However, the shower bath aid of the Moore '635 patent does not provide a removeable brush, and cannot provide compartments for the storage of shower articles such as soap and shampoo. Lastly U.S. Pat. No. Des. 400,658 to Mejia, Sr. discloses a shower back scrubber. However, the shower back scrubber of the Mejia, Sr. '658 patent does not provide a removeable scrubbing element, and does not provide compartments for the storage of shower articles such as soap and shampoo.

While the above-described devices fulfill their respective, particular objectives and requirements, the aforementioned patents do not describe a back scrubber that allows scrubbing with a soothing and massaging effect. The prior art patents make no provision for a removeable brush and compartments for the storage of shower articles such as soap and shampoo.

Therefore, a need exists for a new and improved back scrubber that can be used for scrubbing with a soothing and massaging effect. In this regard, the present invention substantially fulfills this need. In this respect, the back scrubber according to the present invention substantially departs from the conventional concepts and designs of the prior art, and in doing so provides an apparatus primarily developed for the purpose of scrubbing with a soothing and massaging effect.

SUMMARY OF THE INVENTION

In view of the foregoing disadvantages inherent in the known types of back scrubber now present in the prior art, the present invention provides an improved back scrubber, and overcomes the above-mentioned disadvantages and drawbacks of the prior art. As such, the general purpose of the present invention, which will be described subsequently in greater detail, is to provide a new and improved back scrubber which has all the advantages of the prior art mentioned heretofore and many novel features that result in a back scrubber which is not anticipated, rendered obvious, suggested, or even implied by the prior art, either alone or in any combination thereof.

To attain this, the present invention essentially comprises a back scrubber, comprising a base unit, at least one adapter mount attached to the rear side of the base unit, at least one suction cup attached to an adapter mount, at least one slot in the front side of the base unit, at least two tabs adjacent to the slot, a brush unit, and at least one adapter mount attached to the rear side of the brush unit.

In one embodiment, the present invention comprises a back scrubber, comprising a rectangular base unit, at least one adapter mount attached to the rear side of the rectangular base unit, at least one suction cup attached to an adapter mount, a plurality of slots in the front side of the rectangular base unit, a plurality of tabs adjacent to the slots, at least one compartment in the top side of the rectangular base unit, a brush unit, and a plurality of adapter mounts attached to the rear side of the brush unit.

In another embodiment, the present invention comprises a back scrubber that is wall-mountable, comprising a rectangular base unit, a plurality of adapter mounts attached to the rear side of the rectangular base unit, a plurality of suction cups attached to the adapter mounts, a plurality of slots in the front side of the rectangular base unit, a plurality of tabs adjacent to the slots, at least one compartment in the top side of the rectangular base unit, a brush unit, and a plurality of adapter mounts attached to the rear side of the brush unit, wherein the adapter mounts attached to the rear side of the brush unit are configured to fit within the slots in the rectangular base unit and be held in place by the tabs adjacent to the slots.

There has thus been outlined, rather broadly, the more important features of the invention in order that the detailed description thereof that follows may be better understood and in order that the present contribution to the art may be better appreciated.

The invention may also include a soap dish, indentations, and suction cups attached to the brush unit. There are, of course, additional features of the invention that will be described hereinafter and which will form the subject matter of the claims attached.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved back scrubber that has all of the advantages of the prior art back scrubbers and none of the disadvantages.

It is another object of the present invention to provide a new and improved back scrubber that may be easily and efficiently manufactured and marketed.

An even further object of the present invention is to provide a new and improved back scrubber that has a low cost of manufacture with regard to both materials and labor, and which accordingly is then susceptible of low prices of sale to the consuming public, thereby making such back scrubber economically available to the buying public.

Still another object of the present invention is to provide a new back scrubber that provides in the apparatuses and methods of the prior art some of the advantages thereof, while simultaneously overcoming some of the disadvantages normally associated therewith.

Even still another object of the present invention is to provide a back scrubber for scrubbing with a soothing and massaging effect. This allows an individual to concurrently clean and massage in the shower.

Still yet another object of the present invention is to provide a back scrubber that provides compartments for the storage of shower articles such as soap and shampoo. This makes it possible to conveniently arrange a shower area to keep all needed items within reach.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DESCRIPTION OF THE PREFERRED EMBODIMENT

Figure 1:
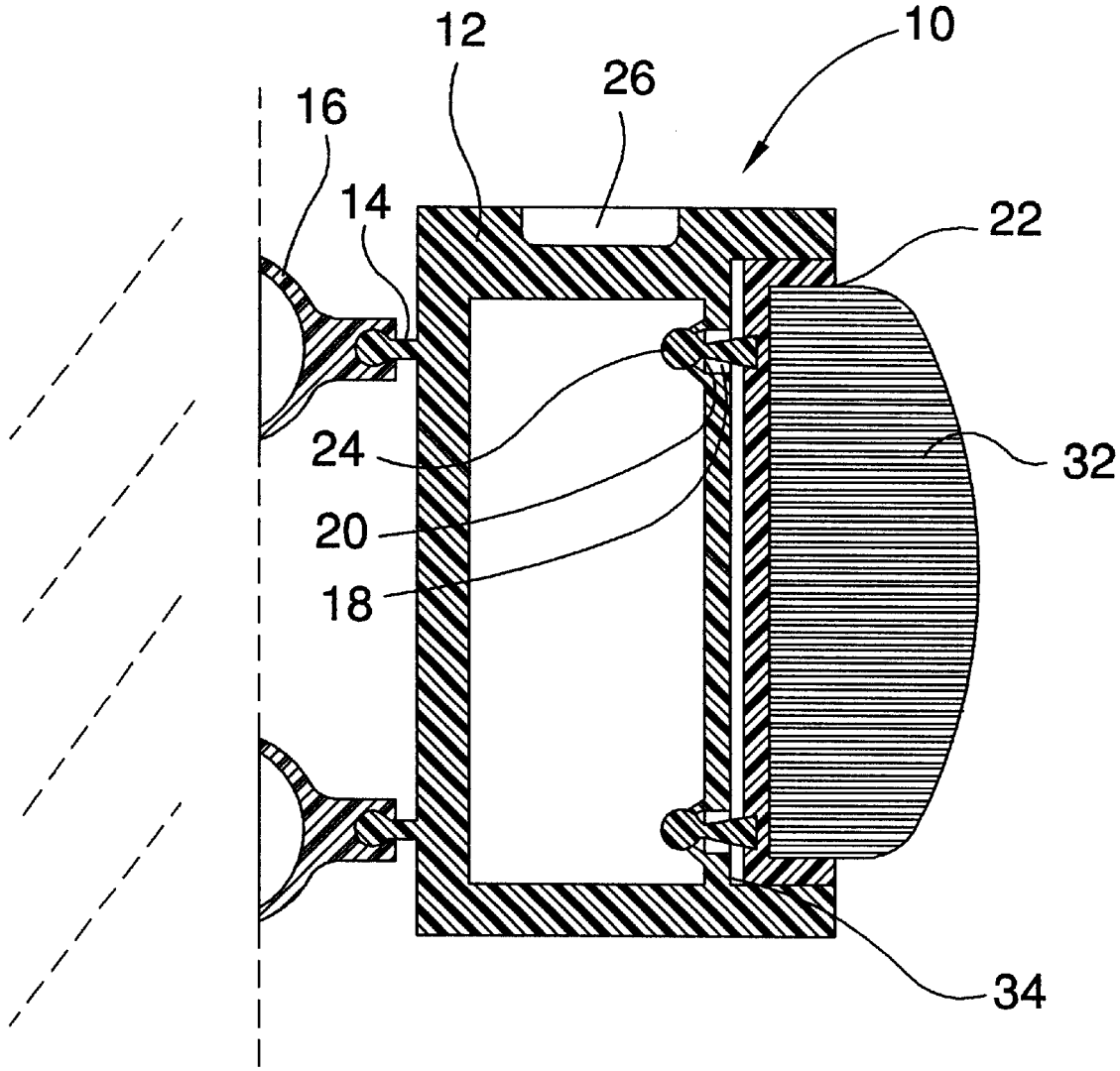
FIG. 1 is a left elevational cross-sectional view of the preferred embodiment of the back scrubber constructed in accordance with the principles of the present invention.
Figure 3:
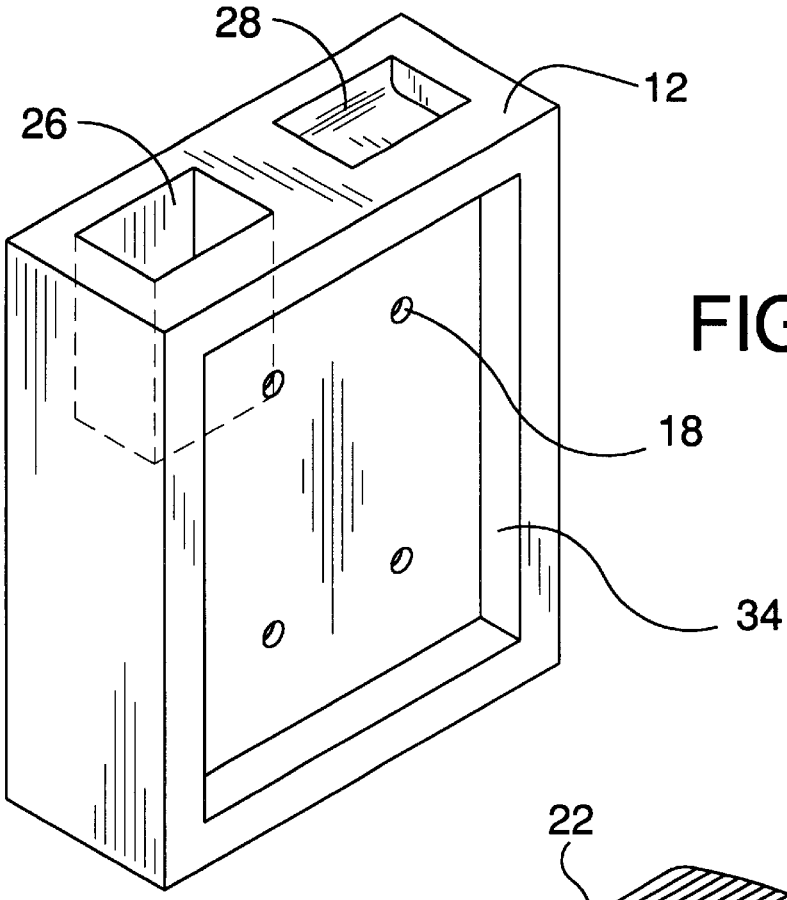
FIG. 3 is an isometric perspective view of the base unit of the back scrubber of the present invention.
Figure 2:
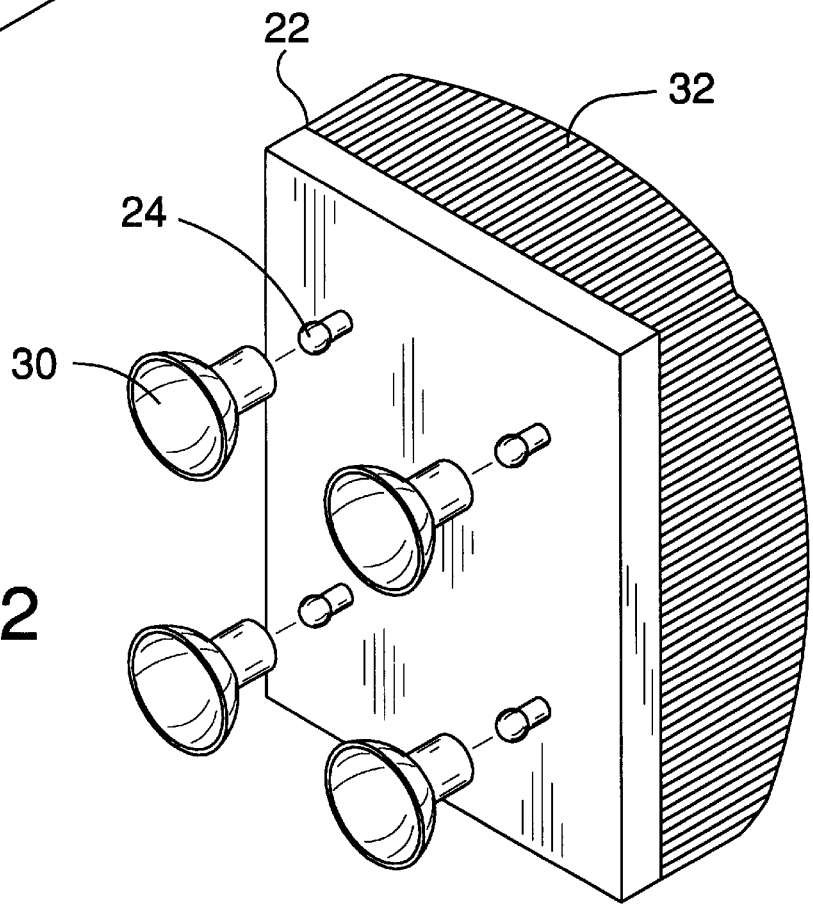
FIG. 2 is an isometric perspective view of the brush unit of the back scrubber of the present invention.

Referring now to the drawings, and particularly to FIGS. 1–3, a preferred embodiment of the back scrubber of the present invention is shown and generally designated by the reference numeral 10.

In FIG. 1, a new and improved back scrubber 10 of the present invention for scrubbing with a soothing and massaging effect is illustrated and will be described. More particularly, the back scrubber 10 comprises a base unit 12, adapter mounts 14 attached to the rear side of the base unit 12, suction cups 16 attached to the adapter mounts 14, slots 18 in the front side of the base unit 12, tabs 20 adjacent to each slot 18, a compartment 26 in the top side of the base unit 12, a brush unit 22 with bristles 32, and brush unit adapter mounts 24 attached to the rear side of the brush unit 22 and configured to fit within the slots 18 in the base unit 12 and be held in place by the tabs 20 adjacent to the slots 18. The front side of the base unit 12 comprises an indentation 34 configured to fit around the rear side of the brush unit 22.

The back scrubber 10 preferably comprises a plastic material. Suitable plastics include molded poly(vinyl chloride) (PVC), polystyrene (PS), poly(methyl methacrylate) (PMMA), nylon, polypropylene (PP), a polyethylene (PE) such as high density polyethylene (HDPE), an acrylonitrile-butadiene-styrene (ABS) resin, a styrene-acrylonitrile (SAN) resin, polycarbonate (PC), a polyester such as polyethylene terephthalate (PET) or polybutylene terephthalate (PBT), or blends thereof, as well as any other suitable plastic material known to those skilled in the art. The brush bristles 32 preferably comprise a plastic material, and more preferably comprise nylon.

FIG. 2 is an isometric perspective view of the brush unit 22 of the back scrubber of the present invention, and illustrates the brush unit adapter mounts 24, and bristles 32. In this embodiment, brush unit suction cups 30 are attached to the brush unit adapter mounts 24, and allow the brush unit 22 to be utilized independently of the base unit 12.

FIG. 3 is an isometric perspective view of the base unit 12 of the back scrubber of the present invention, and illustrates the slots 18, a compartment 26, a soap dish 28, and an indentation 34 configured to fit around the rear side of the brush unit 22 illustrated in FIG. 2. In this embodiment, the base unit 12 is rectangular.

The back scrubber of the present invention is a bathroom accessory that provides a person with a quick and easy way to clean, massage, and scrub the back for overall comfort and hygiene, and without strain. This bathing tool has utility in the home and in commercial establishments such as hotels, motels, hospitals, and nursing homes.

In one embodiment, the back scrubber of the present invention comprises a wall-mounted shower accessory that is attached to a bathroom wall by adapters and rubber suction cups. This plastic unit is produced with a variety of detachable brush pads with a series of nylon bristles for a gentle, yet thorough, scrubbing of the back. Brush pads are produced in soft to hard textures. To use the back scrubber of the present invention, a person simply applies a favorite soap or bath gel to the pad and then leans against the mat. This modernized bathing accessory gently scrubs the back for a soothing and massaging effect. The user can also gently glide his or her shoulders, arms, and other hard-to-reach areas of the body across the unit. In a preferred embodiment, the product is rectangular, and is preferably produced from plastic. It may be produced in a wide range of colors, styles, and patterns to coordinate with any bathroom decor. It may also comprise an optional soap and shampoo holder for added convenience. As a variation, the back scrubber of the present invention may be produced in a similar version that is attached to the wall by the use of an adhesive or adhesive tape.

The back scrubber of the present invention fulfills the need for a bathroom accessory which allows a person to clean, massage, and scrub his or her back with ease and minimal movement. The appealing features of back scrubber of the present invention include its convenience, effectiveness, lightweight nature, ease of use and installation, portability, durability, timesaving nature, eye-catching design, and attractiveness. This modernized bathroom accessory provides a hands-free method of scrubbing, massaging, and cleansing the back. It eliminates the use of a handled brush to wash and massage the back, which can be a difficult and time-consuming process. The back scrubber of the present invention is ideal for the elderly, arthritis sufferers, disabled individuals, and people recovering from surgery having limited physical movement and otherwise depending on other people to clean and scrub their backs. With the back scrubber of the present invention, a person simply leans against the sudsing nylon bristles to effectively cleanse, scrub, and massage the back. This device also massages sore muscles, relieves tension, and may possibly improve circulation. It allows a person to enjoy massaging effects with minimal effort. This bathroom accessory is practical, durable, removable, washable, therapeutic, reasonably priced, easy to use, and attractive. In addition to home use, this unit also has utility in hotels, motels, nursing homes, and hospitals.

In one embodiment, the back scrubber of the present invention is a wall mounted scrubber apparatus having a first base portion mountable to a shower wall, such that the base portion removeably receives a plurality of scrubbing elements via unique lug-like securements, such that the upper region of the central framework comprising the present invention has the ability to store articles normally found within a shower environment.

In use, it can now be understood that the back scrubber of the present invention has particular utility in connection with scrubbing with a soothing and massaging effect, and provides compartments for the convenient storage of shower articles such as soap and shampoo.

While a preferred embodiment of the back scrubber has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, any suitable sturdy material such as aluminum, stainless steel, painted metal, or composite material may be used instead of the plastic described. Also, the suction cups may be made of rubber or similar flexible, elastomeric material. And although scrubbing with a soothing and massaging effect has been described, it should be appreciated that the back scrubber herein described is also suitable for use as a back-scratcher. Furthermore, a wide variety of brush bristles with varying stiffness and different textures may be used.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A back scrubber, comprising:

a base unit;

at least one adapter mount attached to the rear side of the base unit;

at least one suction cup attached to an adapter mount;

at least one slot in the front side of the base unit;

at least two tabs adjacent to the slot;

a brush unit; and at least one adapter mount attached to the rear side of the brush unit.

2. The back scrubber of claim 1, wherein the adapter mount attached to the rear side of the brush unit is configured to fit within the slot in the base unit and be held in place by the tabs adjacent to the slot.

3. The back scrubber of claim 1, wherein the back scrubber is wall-mountable.

4. The back scrubber of claim 1, wherein the base unit is rectangular.

5. The back scrubber of claim 1, further comprising at least one compartment in the top side of the base unit.

6. The back scrubber of claim 1, wherein the base unit further comprises a soap dish.

7. The back scrubber of claim 1, wherein the brush unit further comprises at least one suction cup.

8. The back scrubber of claim 1, comprising a plastic material.

9. A back scrubber, comprising:

a rectangular base unit;

at least one adapter mount attached to the rear side of the rectangular base unit;

at least one suction cup attached to an adapter mount;

a plurality of slots in the front side of the rectangular base unit;

a plurality of tabs adjacent to the slots;

at least one compartment in the top side of the rectangular base unit;

a brush unit; and a plurality of adapter mounts attached to the rear side of the brush unit.

10. The back scrubber of claim 9, wherein the adapter mounts attached to the rear side of the brush unit are configured to fit within the slots in the rectangular base unit and be held in place by the tabs adjacent to the slots.

11. The back scrubber of claim 9, wherein the back scrubber is wall-mountable.

12. The back scrubber of claim 9, wherein the rectangular base unit further comprises a soap dish.

13. The back scrubber of claim 9, wherein the brush unit further comprises a plurality of suction cups.

14. The back scrubber of claim 9, comprising a plastic material.

15. A back scrubber that is wall-mountable, comprising:

a rectangular base unit;

a plurality of adapter mounts attached to the rear side of the rectangular base unit;

a plurality of suction cups attached to the adapter mounts;

a plurality of slots in the front side of the rectangular base unit;

a plurality of tabs adjacent to the slots;

at least one compartment in the top side of the rectangular base unit;

a brush unit; and a plurality of adapter mounts attached to the rear side of the brush unit;

wherein the adapter mounts attached to the rear side of the brush unit are configured to fit within the slots in the rectangular base unit and be held in place by the tabs adjacent to the slots.

16. The back scrubber of claim 15, wherein the rectangular base unit further comprises a soap dish.

17. The back scrubber of claim 15, wherein the brush unit further comprises a plurality of suction cups.

18. The back scrubber of claim 15, wherein the brush unit comprises nylon bristles.

19. The back scrubber of claim 15, wherein the front side of the rectangular base unit comprises a rectangular indentation configured to fit around the rear side of the brush unit.

20. The back scrubber of claim 15, comprising a plastic material.

* * * * *